US008602943B2

(12) United States Patent
Andreasen

(10) Patent No.: US 8,602,943 B2
(45) Date of Patent: Dec. 10, 2013

(54) EXERCISE APPARATUS AND A BRAKE MECHANISM

(75) Inventor: Knud Andreasen, Nykoebing (DK)

(73) Assignee: Atlin Aps, Nykoebing Falster (DK)

( * ) Notice: Subject to any disclaimer, the term of this patent is extended or adjusted under 35 U.S.C. 154(b) by 0 days.

(21) Appl. No.: 13/519,754

(22) PCT Filed: Dec. 28, 2010

(86) PCT No.: PCT/EP2010/070824

§ 371 (c)(1),
(2), (4) Date: Aug. 20, 2012

(87) PCT Pub. No.: WO2011/080284

PCT Pub. Date: Jul. 7, 2011

(65) Prior Publication Data

US 2012/0316035 A1 Dec. 13, 2012

(30) Foreign Application Priority Data

Dec. 29, 2009 (DK) ..... 2009 01386
Sep. 9, 2010 (DK) ..... 2010 00802

(51) Int. Cl.
*A63B 24/00* (2006.01)

(52) U.S. Cl.
USPC ..... 482/7; 482/1; 482/8

(58) Field of Classification Search
USPC ..... 482/1–9, 900–902; 434/247
See application file for complete search history.

(56) References Cited

U.S. PATENT DOCUMENTS 4,930,497 A 6/1990 Saringer
5,421,798 A 6/1995 Bond et al.
5,890,996 A 4/1999 Frame et al.
6,416,448 B1 7/2002 Hassler
6,939,275 B2 * 9/2005 Minogue et al. ..... 482/110
8,083,650 B2 * 12/2011 Ozawa et al. ..... 482/51
2004/0024293 A1 2/2004 Lawrence et al.
2005/0233861 A1 * 10/2005 Hickman et al. ..... 482/8
2008/0248926 A1 10/2008 Cole et al.

FOREIGN PATENT DOCUMENTS

WO WO 03/004107 1/2003

OTHER PUBLICATIONS

International Search Report for International application No. PCT/EP2010/070824 mailed Mar. 23, 2011.

* cited by examiner

*Primary Examiner* — Glenn Richman
(74) *Attorney, Agent, or Firm* — Merchant & Gould P.C.

(57) ABSTRACT

There is provided a continuous motion exercise apparatus for exercising a limb of a patient comprising a housing (1) with an interior compartment communicating with the surroundings through one or more apertures (2), preferably slits in said housing, mechanical activation means (4) for being activated by a limb portion of a person, for instance a foot, a hand, a knee or an elbow of said person, said activation means extending from the interior of said compartment to the surroundings through said one or more apertures, first braking or resistance means (8) for exerting a first resistance against a first force applied to said activation means by said limb portion and arranged in said compartment and connected to said activation means, and at least one second braking or resistance means (9) for exerting at least one second resistance against at least one second force applied to said activation means by said limb portion and arranged in said compartment and connected to said activation means.

15 Claims, 5 Drawing Sheets

EXERCISE APPARATUS AND A BRAKE MECHANISM

This application is a National Stage Application of PCT/EP2010/070824, filed 28 Dec. 2010, which claims benefit of Serial No. PA 2009 01386, filed 29 Dec. 2009 in Denmark and Serial No. PA 2010 00802, filed 9 Sep. 2010 in Denmark and which applications are incorporated herein by reference. To the extent appropriate, a claim of priority is made to each of the above disclosed applications.

FIELD OF THE INVENTION

The present invention relates to an exercise apparatus, preferably portable and preferably for rehabilitative use by a person in a sitting, reclining or lying position for rehabilitation purposes.

BACKGROUND OF THE INVENTION

The prior art is replete with examples of devices for mobilizing the joint of a person's limbs.

U.S. Pat. No. 6,416,448 discloses a therapy and training equipment for constrained knee-joint movement with a lower leg accommodating arrangement, and a guiding arrangement, the arrangements being connected to one another via an articulated device, the guiding arrangement cooperates with the lower leg accommodating arrangement in such a way that, on a rotational movement of one of the lower legs, the other lower leg is constrained to move as a result of the knee-bending movement.

U.S. Pat. No. 4,930,497 discloses an apparatus provided for imparting passive motion exercise to a lower limb of a patient. The apparatus includes a base and a thigh support member having a pair of elongated parallel spaced-apart brace members pivoted at their respective first ends to the base. The other ends of the thigh support brace members terminate at a mechanical hinge. A lower leg support includes a pair of parallel spaced-apart brace members extending from the mechanical hinge. The base is provided with a slide surface for supporting the other ends of the brace members of the lower leg support while allowing for extension and retraction thereof. An electric motor is mounted to the lower leg support to drive the shaft such that the angular movement is provided between the thigh support and the lower leg support, whereby the angular speed is maintained constant when motor speed is constant.

U.S. Pat. No. 5,421,798 discloses an apparatus for evaluation of a limb of a test subject. The apparatus generally includes a pedal or grip to secure the distal end of the limb to the apparatus and a seat to secure the proximal end of the limb to the apparatus. A motor and transmission assembly is coupled to the pedal or grip to provide a controlled load to the distal end of the limb. The apparatus also includes a measurement and control system to determine the load to be applied, and to measure and compute the force on each joint of the limb while the controlled load is applied to the limb. The measurement and control system includes a force sensor, coupled to the pedal, the force sensor being capable of resolving force in at least two directions; a position sensor, coupled to the pedal; and a computer with control software, coupled to the force sensor and the motor, the computer including means for controlling the force exerted on the pedal or grip by the limb of the test subject and the force exerted on the pedal or grip by the motor and transmission.

U.S. Pat. No. 5,890,996 discloses a combined exerciser and physical fitness performance monitoring apparatus and related methods. The apparatus includes at least one fluid working device, such as a pneumatic ram, which serves to provide an adjustable load. The fluid working device is movable using an adjustable mount to vary the compression ratio and loading rate. The fluid working device is connected to a user interface, such as foot pedals or hand holds, using a connection linkage. The apparatus also preferably includes a load modifier which adjustably engages the connection linkage and allows the rate of mechanical loading to be varied. This construction allows a large range of loads and force rates to be achieved.

WO03004107A1 discloses an exercise apparatus, preferably for rehabilitative exercise, and comprising means for allowing resisted linear movement combined with resisted rotative movement of for instance feet of a user, not shown pedals being mounted on shafts (8) attached to a chain (11) extending around sprocket wheels (12-16) provided with first braking means (17), for instance a first electrical motor (17), connected to the chain (11) for exerting a variable resistance against movement to and from the chain with the pedals attached t hereto. The shaft (8) is adapted for rotation against the influence of second braking means, for instance a not shown second electrical motor for exerting a variable resistance against rotation to and from the shaft with the pedals attached thereto. The braking means may be mechanical.

SUMMARY OF THE INVENTION

It is an aim of the present invention to provide an improved apparatus for imparting motion to the lower limb and/or other parts of the body.

It is a further aim of the present invention to provide such a joint mobilizer with a device adjusting the reciprocating cycle of the motor and thus the pitch of hinging movement.

In its broadest aspect the present invention provides an exercise apparatus comprising:

- a housing comprising an interior compartment communicating with the surroundings through one or more apertures (2), preferably slits in said housing;
- mechanical activation means (4) for being activated by a limb portion of a person, for instance a foot, a hand, a knee or an elbow of said person, said activation means extending from the interior of said compartment to the surroundings through said one or more apertures, each mechanical activation means (4) comprises a sensor for sensing the force exerted by the person on the mechanical activation means (4);
- at least one motor positioned in the housing and connected to the mechanical activation means (4) so that moving one of said mechanical activation means (4) in one direction the other activation means is moved in the other direction;
- computer controlling means for controlling the power output of said at least one motor according to input from said sensor; and
- power supplying means for supplying power to said at least one motor and to said computer controlling means;
  whereby the computer controlling means is programmed to trigger said at least one motor to apply assistance and/or resistance to the mechanical activation means (4) to ensure a predetermined speed of the mechanical activation means (4) in response to a force detected by the sensor.

Preferably, said interior compartment is a crank device comprising:

- a frame;
- a pair of crank arms (14, 15) each comprised of:

at least two parts, a first part being an inner crank arm (15) and a second part being an outer crank arm (14);

an inner crank arm axle (16) to which said inner crank arm is attached, a first gear (8) forming a gear through which said inner crank arm axle (16) rotatably extends, said first gear (8) being fixed to the frame;

a second gear (9) rotatably attached to an outer end of the inner crank arm (15), said outer crank arm (14) at one end fixedly attached to said second gear (9) and at the other end carrying said mechanical activation means (4); and means (10 or 17) for connecting the first and second gear;

wherein the pair of inner crank arms (14, 15) are interconnected by connection means provided between said inner crank arms (14, 15) so that moving one of said mechanical activation means in one direction the other activation means is moved in the other direction.

In another aspect the present invention provides an exercise apparatus comprising:

a housing comprising an interior compartment communicating with the surroundings through one or more apertures (2), preferably slits in said housing;

mechanical activation means (4) for being activated by a limb portion of a person, for instance a foot, a hand, a knee or an elbow of said person, said activation means (4) extending from the interior of said compartment to the surroundings through said one or more apertures (2); characterized in that the interior compartment is a crank device comprising:

a frame;

a pair of crank arms (14, 15) each comprised of:

at least two parts, a first part being an inner crank arm (15) and a second part being an outer crank arm (14);

an inner crank arm axle (16) to which said inner crank arm (15) is attached, a first gear (8) forming a gear through which said inner crank (15) arm axle rotatably extends, said first gear (8) being fixed to the frame;

a second gear (9) rotatably attached to an outer end of the inner crank arm (15), said outer crank arm (14) at one end fixedly attached to said second gear (9) and at the other end carrying said mechanical activation means (4); and means (10 or 17) for connecting the first (8) and second (9) gear;

wherein the inner crank arm (15) is connected through the inner crank arm axle (16) to a motor, whereby the rotation of the inner crank arm axle (16) is controlled by computer controlling means for controlling the power output of the electrical motor.

Preferably the mechanical activation means comprises a pedal for receiving a foot. In a preferred embodiment of the present invention the mechanical activation means are adapted for allowing said pedal to move to and from along a linear path determined by said slit in said housing. The slits in said housing normally extend in a generally longitudinal direction relative to the housing.

Preferably, the mechanical activation means (4) includes a motor device to turn the activation means (4) during movement along the one or more apertures (2). In this preferred embodiment the motor device is preferably controlled by the computer controlling means in the same way as the at least one motor connected to the mechanical activation means.

It is preferred that the relationship between the force measured by the sensor and the speed of the mechanical activation means (4) requires that the person applies a force of less than 100 Newton at less than 20 strokes/min, more than 100 Newton above 20 strokes/min, and more than 1000 Newton above 83 strokes/min of the mechanical activation means (4).

The present invention also provides a method of controlling user activation of an exercise apparatus, said method comprising the steps of:

providing a exercise apparatus with reciprocating activation means (4) connected to at least one motor, wherein the reciprocating activation means (4) are equipped with sensors for measuring the force exerted by a user;

providing computer controlling means for controlling mechanical activation and/or resistance in said motor in response to measured forces in said sensors thereby controlling the speed of the activation means (4) in response to the force exerted by the user on the mechanical activation means (4);

sensing a force exerted by the user upon activation of the mechanical activation means (4);

supplying the computer controlling means with the sensed force;

controlling the speed of the activation means (4) in response to the force exerted by the user on the mechanical activation means (4);

wherein the computer controlling means determines when activation or resistance is applied to make sure that the user exercises within a specific speed range.

Preferably the relationship between the force measured by the sensor and the speed of the mechanical activation means (4) requires that the person applies a force of less than 100 Newton at less than 20 strokes/min, more than 100 Newton above 20 strokes/min, and more than 1000 Newton above 83 strokes/min of the mechanical activation means (4).

When referring to the force measured by the sensors in the activation means (4) it is in principle the force difference measured between the two sensors (one sensor in each pedal/activation means). However, since only the leg pressing the pedal/activation means forward normally contributes to the force (the other leg being passive and hence does not exert force on the pedal) it is in principle sufficient to focus on the force measured on the "active" pedal/activation means.

The exercise apparatus of the present invention is suited for use in various positions without any major risk that objects may be damaged by being pinched or caught by the mechanism of the apparatus. Hereby, a very flexible apparatus is achieved whereby exercise of many different types may be attained by means of the variation of the resistance means according to the algorithm best suited to the needs of the person utilising the apparatus. Because of the housing communicating with the surroundings through the apertures, the risk of objects being pinched or caught in the apparatus is greatly reduced. In connection with children or weak, paralysed or handicapped persons or for other reasons it is often desirable that even more features be available for exercising.

Limbs too weak to move the activation means may be exercised by the apparatus exerting a force on the limbs in question, perhaps only under a certain phase of the exercise cycle or during the whole cycle. This may be of use also after operations where it is necessary to move legs and arms so as to avoid blood clots even though the operated person is unconscious or unable to move the limbs in question for some other reason. It is important to note that legs and feet may be exercised separately; the latter being possible by moving the feet forth and back in a circular movement around the pedal axis.

In the currently preferred embodiment of the exercise apparatus according to the invention, the resistance means comprise an electrical generator connected to said activation means such that movement of said activation means rotates said electrical generator. Hereby a simple and easily controlled resistance is available for varying the exercise programme.

Alternatively or additionally, the resistance means may comprise a hydraulic rotary motor or pump connected to said activation means such that movement of said activation means rotates said hydraulic motor or pump.

In a preferred embodiment of the exercise apparatus according to the invention the force exertion means comprise an electrical motor connected to said activation means such that movement of said activation means results from rotation of said electrical motor. Hereby a simple and easily controlled activation means is available for varying the exercise programme. The electrical motor may be the same as or different from the electrical generator utilised for providing a variable resistance. Alternatively or additionally, the force exertion means may comprise a hydraulic rotary motor connected to said activation means such that movement of said activation means results from rotation of said hydraulic motor.

In the currently preferred embodiment of an exercise apparatus according to the invention, said electrical generator is connected to power uptake means for taking up electrical power generated by said generator. Hereby, the power uptake means may be controlled so as to vary the resistance provided by the electrical generator, and said power uptake means preferably comprise a variable electrical resistance, said variable electrical resistance being adapted for being varied by said computer controlling means.

With an exercise apparatus of the present invention (or other similar apparatus) a user may sense that too little pedal speed will feel heavy to enter and excessive speed will be a difficult task to follow on. In between these two regimens a small speed range that people feel comfortable with exists. In many applications the speed range is 50 to 82 pedal strokes per minute. In a preferred embodiment the user may adjust the system so that harder pedal steps applied by the user slightly increases the pedal speed up to a certain limit, while soft pedal steps (i.e. low force applied by the user) results in immediate acceleration (due to low friction/resistance adjusted by the system control unit and/or due to assistance from a motor). The computer controlling means determines when friction/resistance is applied to make sure that the user always exercises within a specific rotational speed range. Since the start of the first accelerating pedal strokes will be done against a very low resistance (e.g. 40-80 Newtons) it is easy for the user to achieve a given rotational speed. If a very narrow rotational speed range is desired the resistance (load) must be exerted at low rotational speeds above which the user will have to apply much more force; accordingly the user will be encouraged to stay below that rotational speed, since it is much more comfortable due to significantly less resistance.

In a preferred embodiment of an exercise apparatus according to the invention, cooling means are provided for cooling said electrical resistance. Hereby, build up of heat is avoided so that the apparatus does not become uncomfortably hot. In cases where the cooling means arranged on or in the apparatus cannot function properly, for instance if the person using the apparatus is bedridden and needs to be covered by a blanket, then it is advantageous that said power uptake means comprise an electrical conduit for connecting said generator to the power mains or an external electrical energy consuming means such as a heater, a battery recharger or the like. Hereby the generated electrical power and location of the resulting heat or power dissipation is transported away from the vicinity of the apparatus.

Although the apparatus may be used for exercising many different portions of the human body, such as arm, wrist, elbow and so on, the currently preferred use is for exercising foot and/or leg muscles and joints of said person, said apertures in said housing being constituted by two slits, preferably generally rectilinear, said activation means comprising two connection members each adapted for connecting a foot receiving means with a mechanism arranged inside said compartment, each of said connection members extending through one of said slits for allowing said connection members to move in a reciprocating, preferably generally rectilinear, manner.

So as to render the apparatus comfortable to use and not prone to hooking and pinching objects in the vicinity thereof, the housing is preferably provided with a smooth, preferably resilient, surface.

So as to be able to use the exercise apparatus according to the invention in many different situations, the housing is preferably provided with fastening means for fastening attachment means for attaching the housing to a chair, a table, a bed, a wheel chair or any other means for accommodating a person utilising the apparatus, and advantageously the housing may be provided with fastening means for fastening supporting means for supporting the housing in a stable position on a horizontal surface such as a floor or a table top.

DETAILED DESCRIPTION OF THE INVENTION

The invention will be explained in more detail in the following in connection with different embodiments of an exercise apparatus according to the invention shown solely by way of example in the accompanying drawings.

Figure 1:
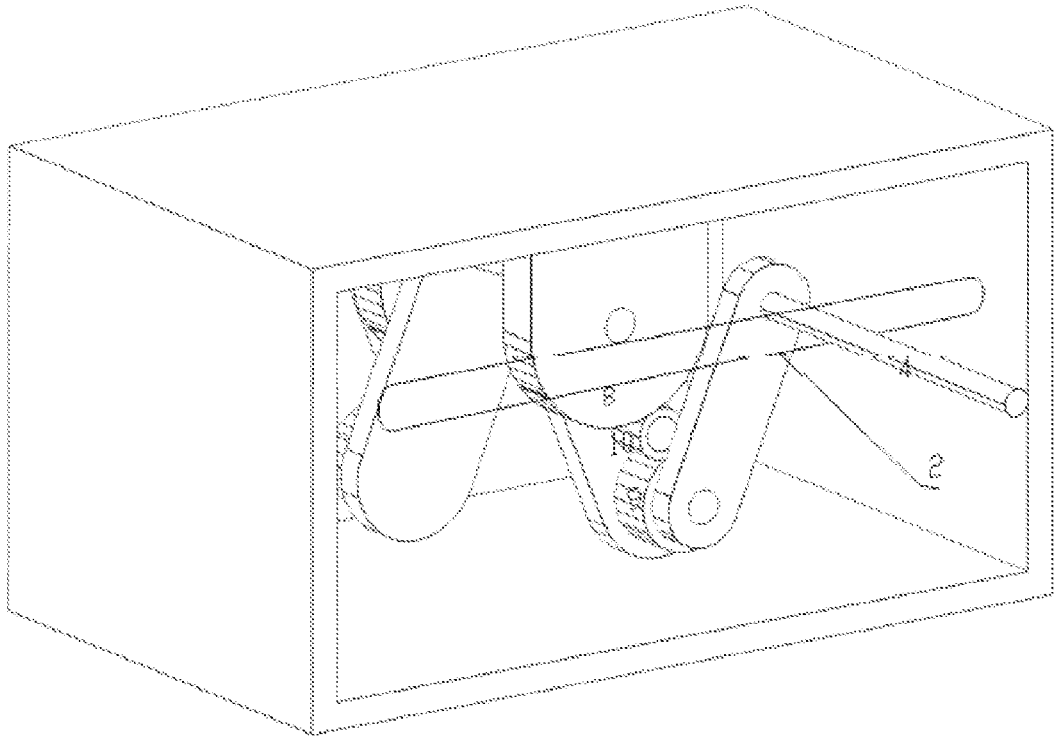
FIG. 1 is a schematic perspective view of a first embodiment of an exercise apparatus according to the invention for exercising muscles, joints and tendons of the legs and/or feet.

Referring to FIG. 1, a housing 1 defining an inner compartment is provided with two elongate apertures or slits 2 on each side of the housing (only one side shown) through which hollow rods 4, respectively extend from the compartment to the surroundings. Foot pedals are pivotably mounted on the rods 4, respectively. The housing 1 in FIG. 1 contains the mechanism shown in FIG. 2.

Figure 2:
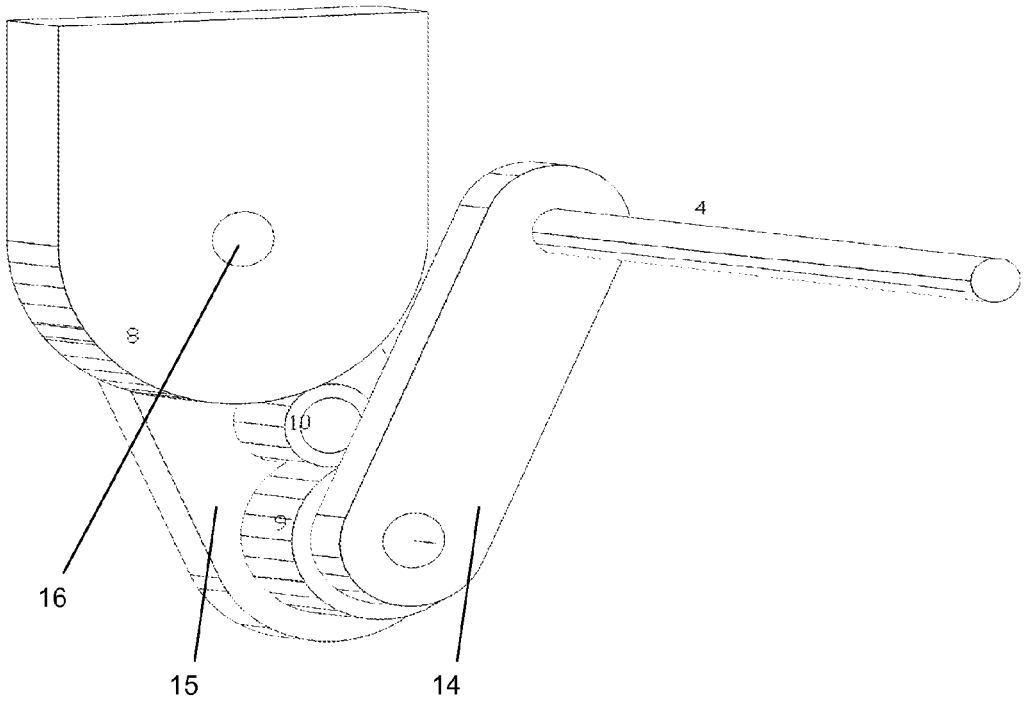
FIG. 2 is a cross section through a glider assembly of the mechanism of the present invention

Referring now to FIG. 2 showing the cross section of the housing shown in FIG. 1 there is provided a pair of crank arms each comprised of two parts, a first part being an inner crank arm and a second part being an outer crank arm. There is also shown an inner crank arm axle to which the inner crank arm is attached. Further the mechanism includes a first gear 8 forming a gear through which said inner crank arm axle rotatably extends, and a second gear 9 rotatably attached to an outer end of the inner crank arm, wherein the outer crank arm at one end is fixedly attached to the second gear and at the other end carrying the pedal. Finally there is shown a cog wheel 10 for connecting the first and second gear.

Figure 3:
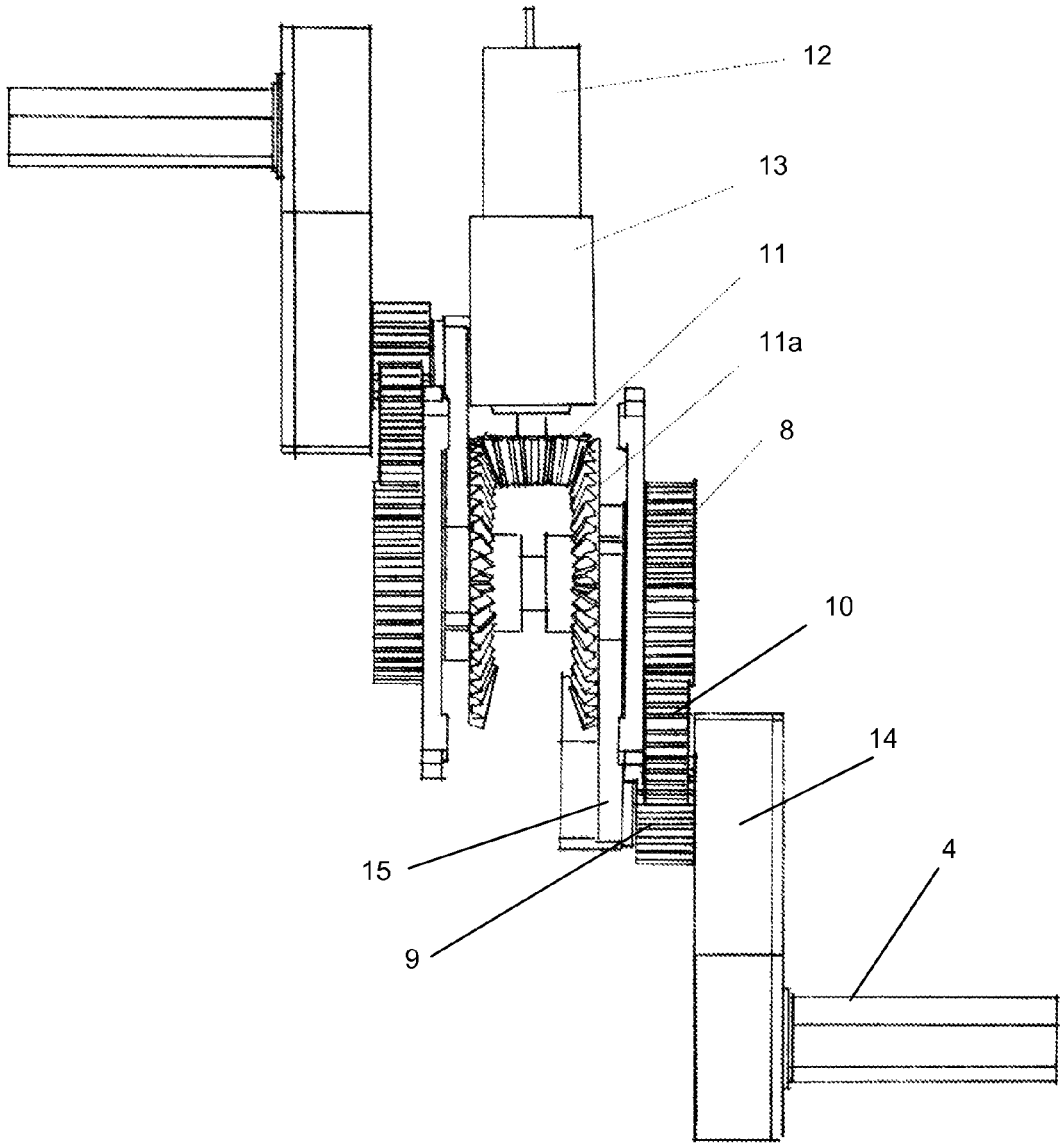
FIG. 3 is a schematic perspective view of a first embodiment of the exercise apparatus showing the essential components of the interconnection between the pedals.

FIG. 3 shows the essential components of the present invention. In order to provide an interconnection between the two pedals 4 and crank arms 14/15 there is provided a connection wheel 11 therein between. The inner crank arms 15 and the outer crank arms 14 are shown in the figure. Specifically, the connection wheel 11 is a gear wheel or similar component that connects through an adjacent gear 11*a* on the inner crank arm. FIG. 3 also shows the first gear 8 forming a gear through which the inner crank arm axle rotatably extends, and a second gear 9 rotatably attached to an outer end of the inner crank arm. There is also shown the cog wheel 10 for connecting the first and second gear. Finally there is shown a motor 12 and a gear box 13.

Figure 4:
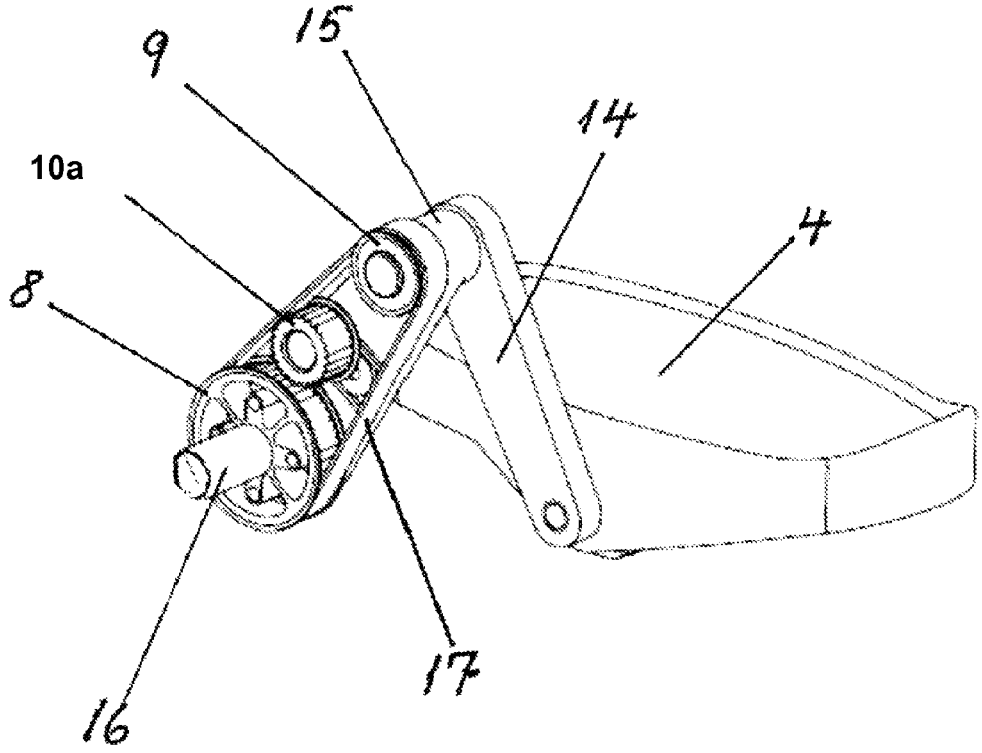
FIG. 4 is a schematic perspective view of an embodiment of the exercise apparatus where the interconnection is made by a belt drive.

FIG. 4 shows the essential components of an embodiment of the present invention based on a belt drive rather than a gear drive as shown in FIG. 3. FIG. 4 only shows one of the drives. The inner crank arms 15 may be interconnected by the means described for FIG. 3 or each crank arm 15 may be connected to a motor or similar device that controls the resistance exerted on and the rotation of the crank arms. FIG. 4 shows a first gear 8 (or belt drive wheel—fixedly attached to a frame (not shown)) and a second gear 9 (or belt drive wheel) rotatably attached to the inner crank arm. The first "gear" 8 forms a gear through which the inner crank arm axle extends. To ensure correct engagement with the belt there is also provided an additional wheel 10*a*, which is forced towards to the belt thereby ensuring correct tension of the belt. The mechanical activation means (4), here a pedal, preferably encloses a motor device that is connected to the outer crank arm and which is able to (rotatably) adjust the position of the pedal relative to the foot during a stroke. In addition to exercising the ankle this also ensures a much more smooth movement of the leg during the stroke. This feature is important for obtaining optimal blood circulation.

Figure 5:
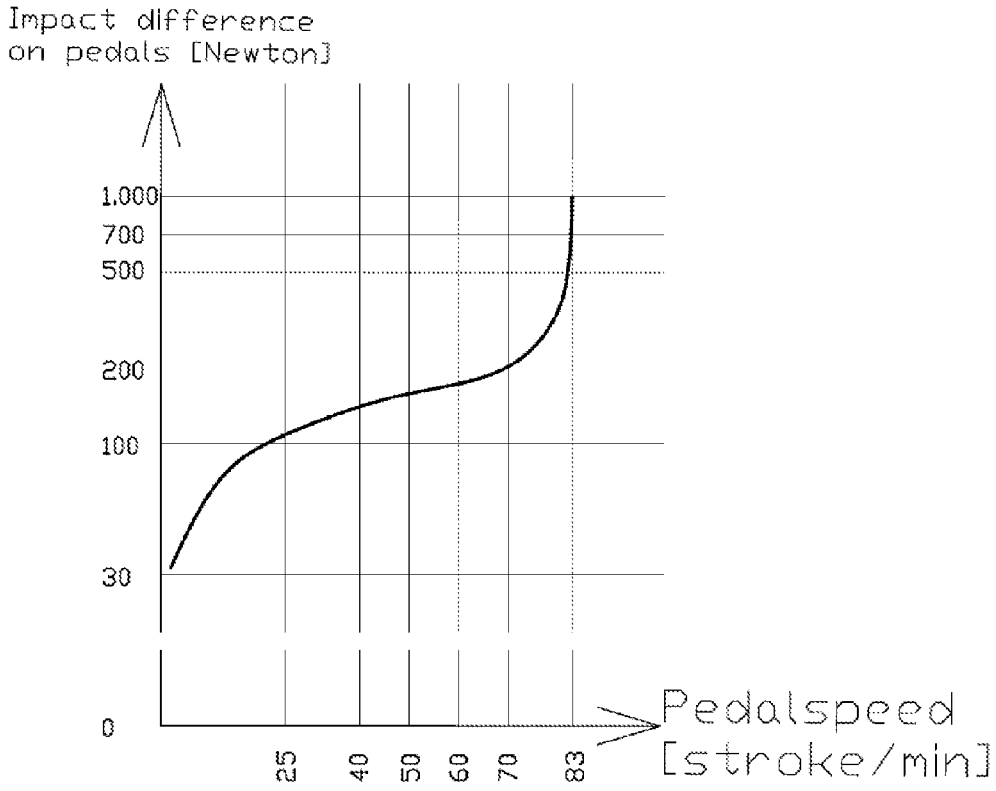
FIG. 5 graphically shows an example of the relationship between measured force on the mechanical activation means (here pedals) and the pedal speed.

FIG. 5 graphically shows the relationship between applied force on the mechanical activation means (here pedals) and the pedal speed. The graph corresponds to a preferred embodiment of the present invention, wherein the motor positioned inside the housing and connected to the mechanical activation means assist the user at low pedal strokes and exerts more and more resistance the higher the pedal speed becomes, up to an upper limit of 83 strokes/minute. The relation between applied force on the mechanical activation means (here pedals) and the pedal speed mimics an automatic gear and ensures that the use mainly exercises within a specific (rotational) speed range.

In use, a person places both feet in the pedals 6, and, in the simplest exercise programme, exercises by moving one pedal away from the person's body whereby the other pedal is moved towards said body because of the interconnection of the pedals by means of a connection wheel. Hereby, the motor functions as a generator and exerts a mechanical resistance against movement of the pedals by the person. Said mechanical resistance is determined by the setting of the electrical resistance which is controlled by computer controlling means in a control box. In the simplest programme, the intensity of the mechanical resistance is constant during the entire stroke of each pedal to and from.

A more sophisticated exercise programme may be implemented by the computer: controlling means such as for instance varying the electrical resistance during the stroke of each pedal such that the resistance is lower at the start and end of a stroke, or the generator may function as a motor at certain points of the stroke to help the person perform the stroke. If one or both legs or feet of a person are paralysed, then the motor may function continuously according to a pre-set algorithm to exercise the paralysed leg or legs.

If the person utilising the apparatus has lost one leg, then the motor may help the remaining leg by pushing the respective pedal back as a replacement for the downward stroke of the missing leg. The pedal corresponding to the missing leg may then be removed.

It will be obvious to those skilled in the art that many different algorithms may be utilised for implementing different exercise programmes combining the resistance of the motor when it functions as a generator with the active help from the motor when it functions as a motor.

In embodiments having electrical resistance and activating means such as an electrical motor or hydraulic/pneumatic resistance/activating means perhaps connected to a computer many other values may be displayed or transmitted to an external registration or computer means for being analyzed and form the basis of a patient evaluation and/or a statistical analysis.

In general, the following considerations are important in connection with a currently preferred embodiment of an exercise apparatus according to the invention: The most effective exercise and rehabilitation of bedridden and other patients with reduced mobility is achieved by exercising the large leg muscles, and for this purpose a particular type of apparatus according to the invention, a leg press, is the currently preferred embodiment of the invention. The apparatus or leg press has been developed as three variants or types, each corresponding to a respective patient group. The patients for whom these apparatuses are made can be divided into three groups according to their condition and needs, and the exercise which each of these three groups can achieve has common features, but is nevertheless different on decisive points. Thus, the three patient groups each use one of the three corresponding leg presses, the three patient groups being designated group 1, 2 and 3 and the apparatuses correspondingly type 1, 2 and 3.

The basic properties such as size, appearance and outer mode of function are: identical as regards the three apparatus types. They have facilities for being secured to the mattress at the foot of the bed, on the floor in front of a chair or a wheel chair.

However, there is a difference between the electrical and/or the mechanical parts of the inner equipment of the different types and thus a difference in their use.

The groups of patients and types of apparatuses are described below such that patient group and apparatus type are described together. Subsequently, the particular conditions concerning each patient group's use of the apparatus type are described briefly.

Patient group 1 comprises in particular ill or elderly walking-impaired people living in their own homes, nursing homes or the like. Some walking-impaired elderly people sit in a chair or lie in bed day and night and many of these elderly people are not well.

Their circulative system degrades, they feel pain in the legs and their difficulty of walking increases. To get up from the chair is very exhausting and the risk of falling increases the efforts needed. Naturally, it would be best for their health to take a walk, but this is not possible for quite many elderly people.

These patients need upkeep exercise for actual strengthening of the walking function and the circulative system. Such exercise will result in upkeep or improvement of the general state of health and in improved quality of life.

It must be possible to achieve the exercise in a gentle way, but nevertheless with the necessary effect. It must be easy to cope with the difficulty in starting the exercising, and the exercising must be adapted individually both as regards the extent of the movements and the strength put into them. Furthermore, it is important to the patients that this exercise takes place in a familiar and natural way.

Apparatus type 1 is the most simple apparatus. It is provided with two pedals formed as individually adjusted foot supports. They can be moved as a pedal stroke, i.e. in linear movement along the apparatus, and they can be tilted or rotated about an axis of rotation in the same manner as a bicycle pedal. The axis of rotation of this tilting can be displaced to lie in an arbitrary place between toes and heel and the length of the pedal stroke is decided by the patient.

If the stroke length is accepted to less than the full length of the apparatus, it is possible to choose whether the pedal stroke takes place at the upper or lower end of the apparatus. If the apparatus is used in bed it will be most convenient if the pedals are nearest to the patient and if it is used on the floor by a chair, the pedals should be nearest to the floor.

The apparatus functions symmetrically as regards the two pedals both in pedal stroke and tilting. The resistance against linear pressing down of the pedals can be adjusted from zero to maximum, which is approximately 1000 Newton against the linear pedal stroke and a smaller torque resistance against pedal tilting or rotation.

Irrespective of the adjustment of the resistance against pedal movements, the resistance is small at the beginning of the movement and increases during the movement. This applies even though the pedal movement has stopped on the way, i.e. it is always easy to start the pedal movements.

Patient group 1 and apparatus type 1. The patient will typically be in surroundings of a familiar kind, either in his own home or in a nursing home. As the leg press must be I available without great preparations, it will probably stand on the floor close to the patient's preferred chair. Both as regards appearance and mode of operation the leg press is made in such a way that it appears as an attractive piece of furniture in the patient's living room. It is easy to pull it in front of the chair and it is easy to place the legs in the foot supports of the pedals. As the resistance against movement is always low at the beginning, it is not exhausting to get going. If the continuation of the pedal movement is too exhausting, the patient stops and continues when he is ready again.

The patient decides the speed, and the stroke length of the pedals is adjusted such that it corresponds to the patient's leg length, the height of the chair and the placement and slope of the leg press.

To force the patient to activate tilting of the ankles, the cycle can be adjusted such that either a powerful tilting of the pedal must be made before it can be pressed down or that the pedal is tilted during the pedal stroke.

The patient cannot fall and the avoidance of pinching injuries has been taken into consideration. It has also been anticipated that the interest of children in what is going on can lead to small fingers getting too near to the apparatus in operation. Similarly, prevention of pinching injuries in this connection has been taken into consideration.

The apparatus is provided with a counter such that the patient can keep up to date as regards the extent of the exercise. In addition, the public health service or other persons can read more data on total energy input, maximum effect etc. perhaps by means of special equipment. These data can be provided with information on points in time, as this type of information may be useful. By means of these data a more: objective picture is achieved of the patient's condition as well as regarding positive or negative development of the patient since the last time read-outs were made.

The best results are obtained when the patient's perception of improved quality of life is in accordance with the measurements of his or her physical condition. In case of discrepancies nurse or physiotherapist can alter the exercise programme somewhat: by adjusting the apparatus and thus achieve a more distinct development in the patient's own perception of his or her quality of life.

Patient group 2 and apparatus type 2. Patient group 2 comprises patients who have to continue rehabilitation after discharge from a hospital after disease, operation, accident, thrombus, cerebral I haemorrhage etc. The patients are in their own homes or transferred to convalescent homes or the like, and the exercise is typically aimed at reconstructing strength and condition and it is a question of supporting and preferably accelerating the recovery process. The rehabilitation aims at bringing the patient back to a condition as close to the previous one as possible.

Some patients in this group, for instance some apoplexy patients, are one-sided paralysed persons, and for several reasons they will have a great need for exercising both legs, also the paralysed one. A quick return to a normal life depends on persistent efforts in re-training both legs. Thus, exercise of one-sided paralysed patients will to a great degree take place in the same way as for non-paralysed patients.

Some patients will benefit from the exercise obtained by being encountering resistance against bending the legs, i.e. pulling at the pedal. This can be combined with the general exercise performed by leg stretching, i.e. pressing down the pedal, if the press prevents leg stretching until a certain pull at the other pedal is registered. Combined exercises of this kind will be particularly suitable for patients in this group.

Like the one-sided paralysed patients the one-sided leg amputees have a great need for exercise. Also for these patients it is important to get going as soon as possible.

The quickly initiated exercise gives the best long-term results and for these patients it is a particular problem to get sufficiently all-round and extensive exercise.

Apparatus type 2 has some unsymmetrical functions as it is also used by one-sided paralysed or amputated persons. It is equipped like apparatus type 1, but the return movement of a pedal can be performed by the apparatus itself. This means that exercising a one-sided paralysed patient or a person with a missing or very weak leg can take place more or less in the same way as for persons without this handicap.

Furthermore, the apparatus can be adjusted to offer a separately adjustable resistance against a pulling of one or both pedals.

Adjustments of various combinations of conditions and movements can be made such that the patient exercises as much as possible with the available muscular activity.

The apparatus is provided with a control means enabling the patient to monitor and control the exercise when assisted exercise is used, for instance for one-sided paralysed patients. The apparatus can be stopped immediately if a movement does not feel comfortable.

The measuring and registration equipment of the apparatus is more comprehensive than the equipment of apparatus type 1. Apart from data readable on the display of the apparatus, data can be read out by means of a data collection device which can be connected directly or by telephonic data transmission.

The attending physician can use some of these measurements or physiotherapist for registering the patient's condition, both in absolute terms and relative to previous measurements. This information can be used when planning the further development of the rehabilitation.

Patient group 2 and apparatus type 2: Patients in this group may be bedridden initially, typically in their own homes, and later to an increasing extent out of bed.

Therefore, at the beginning of this part of the rehabilitation, the leg press will be used in bed and later by a chair, possibly a wheel chair.

As a great deal of data relating to the patient's condition is measured and registered in connection with the type 2 apparatus, the rehabilitation can be optimized considerably.

As one-sided paralysed patients are often involved, it is a particular advantage that the walking function can be retrained without risk of falling. Experience shows that exercise of the healthy leg also improves the paralysed leg. Furthermore, if the patient is able to exercise the paralysed leg, assisted by motors of the leg press, it is to be expected that the total activity involved will promote the recovery. The concentration and the efforts in this connection will probably promote the rehabilitation and as the load can be reduced it is possible to exercise and thus concentrate on the muscular activity of the legs for quite a long time without risk of overloading muscles and joints. Patient group 3 and apparatus type 3 Patient group 3 comprises hospitalized patients beginning rehabilitation immediately after the operation. These patients need apparatuses with a special degree of flexibility as their exercise will be hampered partly by reduced freedom of movement, partly by the fact that at the beginning there will be pain in connection with movement.

For these patients the exercise apparatus must be able to follow and assist the patient's often small improvements. Its functions must be extremely sensitive such that the patient's attempts to exercise are exploited as much as possible. This applies in particular during the first period of time after an operation, accident or other violent incident. After discharge from the hospital the further rehabilitation of the patient will often take place at the premises of a practicing physiotherapist and accordingly as for patient group 2 in this connection. It will be possible to continue the rehabilitation as described for this group.

Apparatus type 3 is intended for all the applications mentioned in type 1 and in type 2. The measuring and registration equipment is more comprehensive and contains more i registrations for statistical use.

This type of apparatus will form part of the further development of methods of better rehabilitation of patients after incidents that have changed the patient's mobility violently for a short or long time.

Patient group 3 and apparatus type 3: The patients are typically bedridden. Furthermore, their freedom of movement can be limited by bandages, infusion devices and the like, and under these circumstances heavy demands are made to the flexibility I and the possibilities of adjustment of the leg press when in use.

The apparatus may be in the patient's bed day and night, but more probably it will mainly only be in the bed when used. Of course, the patient needs help in connection with displacing the leg press, but the patient can manage the exercise itself alone. This means that exercising can take place at times where the patient is ready for it. The assistance which must be rendered by others is to an extent corresponding to most other acts of the nursing and it can be rendered by anyone participating in this nursing function.

Therefore, the rehabilitation of the more active patients can be much more intense and effective than is possible with prior art exercise and rehabilitation devices and even for less active patients great improvements of the rehabilitation can be achieved by using a type leg press according to the invention.

The invention claimed is:

1. An exercise apparatus comprising:

a housing comprising an interior compartment communicating with the surroundings through one or more apertures, preferably slits in said housing;

mechanical activation means for being activated by a limb portion of a person, for instance a foot, a hand, a knee or an elbow of said person, said activation means extending from the interior of said compartment to the surroundings through said one or more apertures, each mechanical activation means comprises a sensor for sensing the force exerted by the person on the mechanical activation means;

at least one motor positioned in the housing and connected to the mechanical activation means so that moving one of said mechanical activation means in one direction the other activation means is moved in the other direction;

computer controlling means for controlling the power output of said at least one motor according to input from said sensor; and power supplying means for supplying power to said at least one motor and to said computer controlling means;

whereby the computer controlling means is programmed to trigger said at least one motor to apply assistance and/or resistance to the mechanical activation means to ensure a predetermined speed of the mechanical activation means in response to a force detected by the sensor.

2. An exercise apparatus according to claim 1, wherein the relationship between the force measured by the sensor and the speed of the mechanical activation means requires that the person applies a force of less than 100 Newton at less than 20 strokes/min, more than 100 Newton above 20 strokes/min, and more than 1000 Newton above 83 strokes/min of the mechanical activation means.

3. An exercise apparatus according to claim 1, wherein each mechanical activation means is connected to its own motor.

4. An exercise apparatus according to claim 1, wherein said interior compartment is a crank device comprising:

a frame;

a pair of crank arms each comprised of:

at least two parts, a first part being an inner crank arm and a second part being an outer crank arm;

an inner crank arm axle to which said inner crank arm is attached;

a first gear forming a gear through which said inner crank arm axle rotatably extends, said first gear being fixed to the frame; and a second gear rotatably attached to an outer end of the inner crank arm, said outer crank arm at one end fixedly attached to said second gear and at the other end carrying said mechanical activation means.

5. An exercise apparatus according to claim 1, wherein said mechanical activation means comprises a pedal for receiving a foot.

6. An exercise apparatus according to claim 1, wherein said mechanical activation means includes a motor device to turn the activation means during movement along the one or more apertures.

7. An exercise apparatus according to claim 1 wherein said mechanical activation means are adapted for allowing said pedal to move to and from along a linear path determined by said one or more apertures.

8. An exercise apparatus according to claim 1, wherein said one or more apertures in said housing extend in a generally longitudinal direction relative to the housing.

9. An exercise apparatus according to claim 4, wherein said inner crank arms are interconnected through a connection wheel, such as a gear wheel, that connects through a perpendicularly oriented adjacent wheel, such as a gear, on the inner crank arm.

10. An exercise apparatus according to claim 4, wherein the means for connecting the first and second gear comprises a belt or a cog wheel.

11. An exercise apparatus according to claim 1, wherein the predetermined speed in response to a force detected by the sensor follows the curve of FIG. 5.

12. A method of controlling user activation of an exercise apparatus according to claim 1, said method comprising the steps of:

sensing a force exerted by the user upon activation of the mechanical activation means;

supplying the computer controlling means with the sensed force;

applying activation or resistance to the mechanical activation means depending on the sensed force;

wherein the computer controlling means determines when activation or resistance is applied to make sure that the user exercises within a specific speed range.

13. The method of claim 12, wherein the relationship between the force measured by the sensor and the speed of the mechanical activation means requires that the person applies a force of less than 100 Newton at less than 20 strokes/min, more than 100 Newton above 20 strokes/min, and more than 1000 Newton above 83 strokes/min of the mechanical activation means.

14. A method of controlling user activation of an exercise apparatus, said method comprising the steps of:

providing a exercise apparatus with reciprocating activation means connected to at least one motor, wherein the reciprocating activation means are equipped with sensors for measuring the force exerted by a user;

providing computer controlling means for controlling mechanical activation and/or resistance in said motor in response to measured forces in said sensors thereby controlling the speed of the activation means in response to the force exerted by the user on the mechanical activation means;

sensing a force exerted by the user upon activation of the mechanical activation means;

supplying the computer controlling means with the sensed force;

controlling the speed of the activation means in response to the force exerted by the user on the mechanical activation means;

wherein the computer controlling means determines when activation or resistance is applied to make sure that the user exercises within a specific speed range.

15. The method of claim 14, wherein the relationship between the force measured by the sensor and the speed of the mechanical activation means requires that the person applies a force of less than 100 Newton at less than 20 strokes/min, more than 100 Newton above 20 strokes/min, and more than 1000 Newton above 83 strokes/min of the mechanical activation means.

* * * * *